US006276322B1

(12) United States Patent
Sekiya et al.

(10) Patent No.: US 6,276,322 B1
(45) Date of Patent: Aug. 21, 2001

(54) VALVE TIMING REGULATION DEVICE

(75) Inventors: Mutsuo Sekiya; Katsuyuki Numoto, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/518,640

(22) Filed: Mar. 3, 2000

(30) Foreign Application Priority Data

Sep. 29, 1999 (JP) ..... 11-277133

(51) Int. Cl.[7] ..... F01L 1/344
(52) U.S. Cl. ..... 123/90.17; 123/90.19
(58) Field of Search ..... 123/90.15, 90.17, 123/90.19, 90.31; 74/568 R; 464/1, 2, 160, 161

(56) References Cited

U.S. PATENT DOCUMENTS 4,858,572 8/1989 Shirai et al. ..... 123/90.12
5,738,056 * 4/1998 Mikame et al. ..... 123/90.17
5,797,361 8/1998 Mikame et al. ..... 123/90.17
5,816,204 * 10/1998 Moriya et al. ..... 123/90.17
5,823,152 * 10/1998 Ushida ..... 123/90.17
5,836,278 * 11/1998 Scheidt ..... 123/90.17
5,957,098 9/1999 Fukuhara et al. ..... 123/90.17

* cited by examiner

*Primary Examiner*—Weilun Lo
(74) *Attorney, Agent, or Firm*—Sughrue, Mion, Zinn, Macpeak & Seas, PLLC

(57) ABSTRACT

When a rotor and a case are formed from different materials, deformation and early wear due to insufficient strength of an engagement hole of a lock means which locks the relative rotation of the rotor and the case can be prevented. Furthermore it is possible to maintain a clearance between the sliding faces of the rotor and the case in response to temperature variations. A second rotating body 6 is formed form a material with a greater linear expansion coefficient than a first rotating body 2, and an engagement hole 21 which stores a lock means 20 in a second rotating body 6 and which engages and disengages a lock means 20 is provided in the first rotating means 2. The second rotating body 6 and the locking means 20 are formed form a material with approximately the same linear expansion coefficient.

4 Claims, 4 Drawing Sheets

VALVE TIMING REGULATION DEVICE

BACKGROUND OF THE INVENTION

1. Field of the Invention

The present invention relates to a valve timing regulation device for varying the opening and closing timing of one or both of an intake valve or an exhaust valve in response to the operational conditions of an internal combustion engine.

2. Description of the Prior Art

A conventional valve timing regulation device comprises a case which is mounted to rotate freely on a camshaft which opens and closes intake and exhaust valves of an internal combustion engine and which is rotated by an output force of the internal combustion engine, a rotor which is stored in the case, is engaged with the camshaft and which rotates relative to the case, an engagement hole for locking which is provided on one of the case or the rotor, and a lock pin which is provided on the other of the case or the rotor which does not mount the engagement hole, which engages by insertion into the engagement hole due to a mechanical biasing force to lock the relative rotation of the rotor and the case and which disengages from the engagement hole due to a hydraulic control force to release the locking. The case has a plurality of shoes which project inwardly and the rotor has a plurality of vanes which project outwardly. The supply of hydraulic pressure selectively to advancing and retarding hydraulic pressure chambers which are formed between the shoes and vanes is automatically controlled in response to the operational conditions of the internal combustion engine. Thus the rotor is operated in an advancing or retarding direction due to a pressure differential between the advancing and retarding hydraulic pressure chambers. The opening and closing timing of the intake and exhaust valves is controlled as a result. Each vane of the rotor and each shoe of the case has a tip seal on each respective tip to prevent the leakage of oil between the advancing and retarding hydraulic pressure chambers.

A valve timing regulation device normally entails the requirement of minimizing the clearance between the sliding faces of the case, its covering member and the rotor. The case, its covering member and the rotor expand or contract due to heat as a result of temperature variation during operation of the internal combustion engine. At such times, when the linear expansion coefficient of the case, its covering member and the rotor differs greatly, the clearance with respect to the sliding face undergoes a large variation and considerable oil leakage can be generated from the resulting clearance. Conversely the rotor in a lock release state may be pressed onto the case due to thermal expansion and stopped from rotating. This results in impairment to the control performance of the valve opening and closing timing.

It has been proposed to form the case, its covering member and the rotor from a material with the same linear expansion coefficient in order to reduce variation in the clearance due to temperature variations during operation of the internal combustion engine as much as possible.

However even in valve timing regulation devices in which the case, its covering member and the rotor are formed from different materials, it is still necessary to suppress variations in the clearance, which is set between the sliding faces of the case, its covering member and the rotor which results from temperature variations during operation of the internal combustion engine.

Since a conventional valve timing regulation device is formed as discussed above, when the rotor and the case are formed from the same material, for example from an aluminum material with the same linear expansion coefficient, a locking pin is formed in one of the rotor and the case with an engagement hole being formed in the remaining component. In this way, the engagement hole must have a maximum mechanical strength since a shear force operates in the direction of rotation of the rotor when the lock pin is engaged. However an engagement hole provided on the case or the rotor which is formed from an aluminum material does not have sufficient strength results in early wear or deformation of the engagement hole. As a result not only is shaking and normal noise generated on engagement of the lock pin and the engagement hole, there is a high probability of considerable damage to the control performance of the valve and closing timing.

A conventional valve timing regulation device entails various problems with respect to the disposition of a lock means on either the case or the rotor or the direction of operation of the lock means with respect to the rotational center of the case and the rotor even when the case, its covering member and the rotor are formed from different materials. For example, when a lock pin is formed near the case is formed from an iron material and an engagement hole is provided on the rotor and is formed from an aluminum material, as discussed above, in the same way as when the case and the rotor are formed from the same material, early wear or deformation of the engagement hole occurs due to insufficient strength of the engagement hole. Thus a deviation is generated between the lock pin and the engagement hole during locking of the rotor and there is a high probability of considerable damage to the control performance of the valve opening and closing timing.

In particular as discussed above, when the case, its covering member and the rotor are formed from different materials, even under any kind of temperature conditions during operation of the internal combustion engine, it is ideal to maintain an optimal clearance to prevent oil leakage and allow relative rotation of the sliding faces of the case and the rotor. For this reason, the case and the rotor must have set dimensions depending on the temperature conditions. However the problem has arisen that a technical solution has not been found.

SUMMARY OF THE INVENTION

The present invention is proposed to solve the above problems. The valve timing regulation device of the present invention comprises a first rotating body and a second rotating body stored in the first rotating body which are formed from different types of materials. The valve timing regulation device of the present invention has the object of preventing deformation and early wear of the engagement hole of the lock means which locks the relative rotation of the first and second rotating bodies, suppressing reductions in performance as a result of temperature variation during operation of the internal combustion engine to extremely low levels, stabilizing performance during valve opening and closing timing and improving reliability.

The present invention has the object providing a valve timing regulation device which enables simple formation of the first and second rotating bodies with different materials, improvements in efficiency and cost reductions.

The present invention has the object providing a valve timing regulation device which can maintain an optimal clearance between the sliding faces of the first and second rotating bodies in response to temperature variation during operation of the internal combustion engine.

A valve timing regulation device of the present invention comprises a first rotating body which is provided to rotate freely on a camshaft which opens and closes at least one of an intake valve and an exhaust valve of an internal combustion engine, the first rotating body being rotated by an output force of the internal combustion engine, a second rotating body which is stored in the first rotating body to undergo relative rotation in a fixed angular range, the second rotating body being engaged to said camshaft, and a locking means which is operated by a mechanical biasing force, which locks a relative rotation of the first and second rotating bodies and which releases the locking on being operated by a hydraulic control pressure. The invention is characterized in that the valve timing regulation device is further characterized in that the second rotating body is formed from a material having a greater linear expansion coefficient than the first rotating body, the locking means is stored on the second rotating body, and is operated in a direction which is parallel with a center of rotation of the first rotating body and the second rotating body, and an engagement hole is provided on the first rotating body and engages and disengages the locking means.

A valve timing regulation device according to the present invention is characterized in that the first rotating body which is formed from an iron material, and the second rotating body is formed from a aluminum material.

A valve timing regulation device according to the present invention is characterized in that the first rotating body is formed by iron sintering, and the second rotating body is formed by aluminum casting or molding.

A valve timing regulation device according to the present invention is characterized in that an axial longitudinal length of the second rotating body is formed to be shorter in a range of 20 to 80 microns under ambient temperature conditions than an axial longitudinal length of the first rotating body.

A valve timing regulation device according to the present invention is characterized in that the second rotating body and the locking means stored on said second rotating body are formed from a material with approximately the same linear expansion coefficient.

A valve timing regulation device according to the present invention comprises a first rotating body which is provided to rotate freely on a camshaft which opens and closes at least one of an intake valve and an exhaust valve of an internal combustion engine, the first rotating body being rotated by an output force of the internal combustion engine, a second rotating body which is stored in the first rotating body to undergo relative rotation in a fixed angular range, the second rotating body being engaged to said camshaft, and a locking means which is operated by a mechanical biasing force, which locks a relative rotation of the first and second rotating bodies and which releases the locking on being operated by a hydraulic control pressure. The valve timing regulation device according to the present invention is characterized in that the valve timing regulation device is further characterized in that the second rotating body is formed from a material having a smaller linear expansion coefficient than the first rotating body, the locking means is stored on the first rotating body, and is operated in a radial direction about the axial center of the first rotating body and the second rotating body, and an engagement hole is provided on the second rotating body and engages and disengages the locking means.

A valve timing regulation device according to the present invention is characterized in that the first rotating body is formed from an aluminum material, and the second rotating body is formed from an iron material.

A valve timing regulation device according to the present invention is characterized in that the first rotating body is formed by aluminum casting or aluminum molding, and the second rotating body is formed by iron sintering.

A valve timing regulation device according to the present invention is characterized in that an axial longitudinal length of the second rotating body is formed to be shorter in a range of 20 to 80 microns under ambient temperature conditions than an axial longitudinal length of the first rotating body.

A valve timing regulation device according to the present invention is characterized in that the first rotating body and the locking means stored on said first rotating body are formed from a material with approximately the same linear expansion coefficient.

DETAILED DESCRIPTION OF THE PREFERRED EMBODIMENTS

The preferred embodiments of the present invention will be described below.

Embodiment 1

Figure 1:
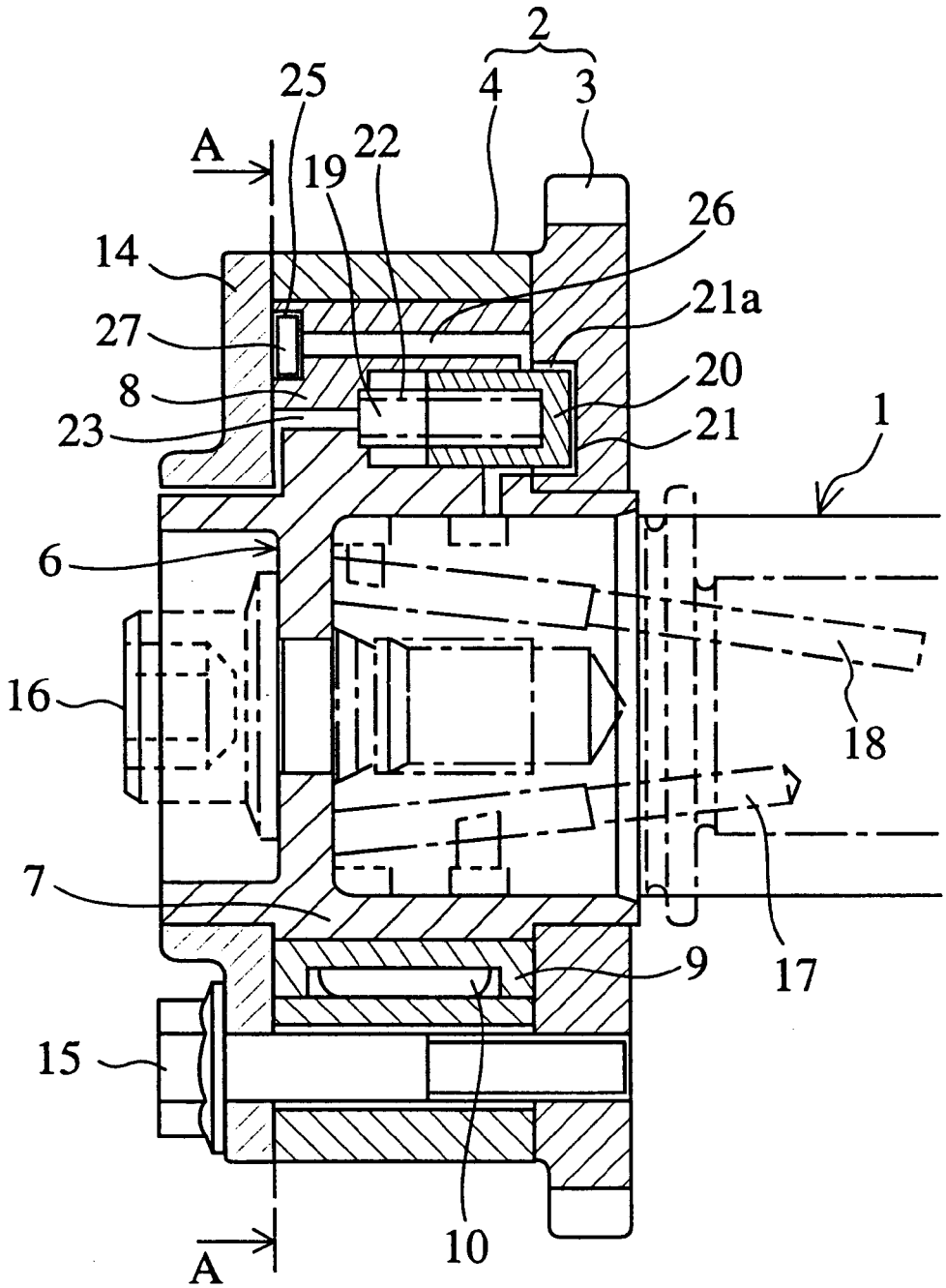
FIG. 1 shows a cross sectional view of a valve timing regulation device according to a first embodiment of the present invention.
Figure 2:
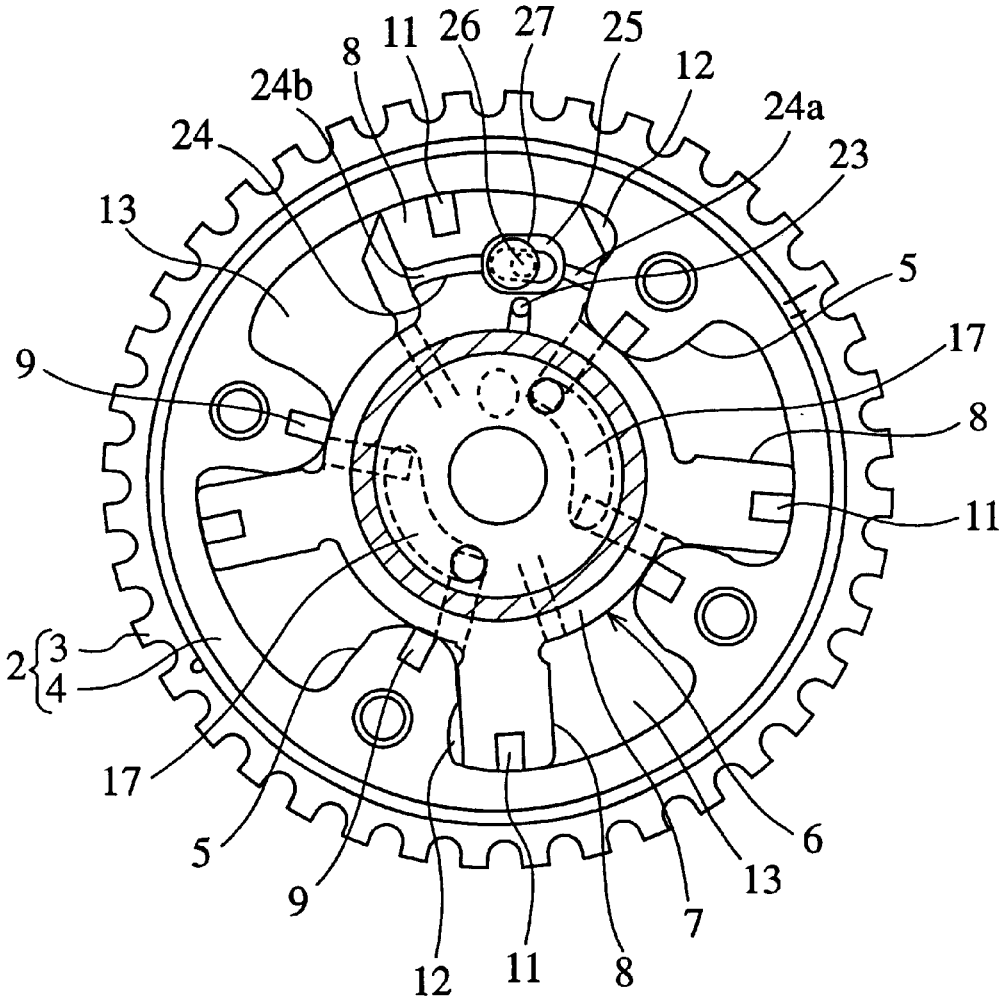
FIG. 2 is a perspective drawing on a cross section along the line A—A in FIG. 1.

FIG. 1 is a cross sectional view of a valve timing regulation device according to a first embodiment of the present invention. FIG. 2 is a perspective drawing on a cross section along the line A—A in FIG. 1. In FIG. 1, reference numeral 1 denotes a camshaft which opens and closes a valve of the intake or exhaust system of an internal combustion engine, 2 is a first rotating body which is retained to rotate freely on the camshaft 1. The first rotating body 2 is in a housed form and is provided with a timing pulley or a timing sprocket (hereafter called a timing rotating body) 3 which inputs the rotational drive force from a crankshaft (not shown) in the internal combustion engine and a cylindrical case 4 pierced in a cross sectional direction which is fixed to one face of the timing rotating body 3. A plurality of shoes 5 which project towards a rotational center of the camshaft 1 are integrally provided on an inner periphery of the case 4 as shown in FIG. 2.

6 is a rotor which is linked and fixed to the camshaft 1 and is housed in the case 4. The rotor 6 is a second rotating body which rotates relative to the first rotating body 1. A plurality of vanes 8 (the same number as the shoes 5) are provided on the rotating body (boss section) of the rotor 6 protruding towards the radial direction as shown in FIG. 2.

9 is a tip seal provided on the tip of each shoe 5. 10 is a back spring of the tip seal. The tip seal 9 contacts the rotating body 7 of the rotor with the back spring 10 providing a rear biasing force. 11 is a tip seal provided on the tip of each vane 8. The tip seal 11 contacts an inner peripheral face of the case 4 and is provided with a back spring (not shown) in the same way as the tip seal 9 on the tip of the seal 5.

12 is a retarding hydraulic pressure chamber for displacing each vane 8 in a retarding direction. 13 is an advancing hydraulic pressure chamber for displacing each vane 8 in an advancing direction. The retarding hydraulic pressure chamber 12 and the advancing hydraulic pressure chamber 13 are adapted to supply a working oil from a fan-shaped space formed between each shoe 5 and each vane 8 to the case 4 and rotor 6.

14 is a covering member assembled on the end opposite the timing rotating body 3 in the case 4. 15 is a fixing bolt which is integrated with the timing rotating body 3, the case 4 and the covering member 14. Thus the covering member 14 forms an integrated rotating component of the case 4 and comprises a section of the first rotating body 2. 16 is an axial bolt which fixes the rotor 6 to the end of the camshaft 1. 17 is a first oil passage provided on the camshaft 1 and the rotor 6. The first oil passage 17 is linked with the retarding hydraulic pressure chamber 12. 18 is a second hydraulic passage provided on the camshaft 1 and the rotor 6 in the same way. The second hydraulic passage 18 is linked with the advancing hydraulic pressure chamber 13.

19 is a pinhole which is provided along the axial direction of one vane 8 of the rotor 6. 20 is a lock pin (locking means) which is retained to be slidable in the pin hole 19 and which operates in a direction which is parallel to the rotational axis of the rotor 6 (axis of rotation of the camshaft 1). 21 is an engagement hole which is formed on the sliding face of the vane 8 in the timing rotating body 3 which is an integrated rotating component of the case 4. The engagement hole 21 is formed by an indentation and can engage and disengage the lock pin 20. 21*a* is a small gap allowing passage of oil which is formed between the lock pin 20 and the inner face of the engagement hole 21 when the lock pin 20 is engaged with the engagement hole 21. 22 is a spring which acts as a mechanical biasing means to bias the lock pin 20 in an engaging direction with respect to the engaging hole 21. 23 is an air release hole provided on the rotor 6, which opens the side on which the spring 22 is stored in the pin hole 19 to the atmosphere and has the dual functions of air hole and drain passage.

In FIG. 2, 24 is a linking oil passage which is provided on the vane 8 which has the lock pin 20 and which links the advancing and retarding oil pressure chambers 12, 13 on both sides of the vane 8. The linking oil passage 24 is formed by a peripheral groove provided on a lateral face near the covering member 14 of the rotor 6 as shown in FIG. 1. 25 is an elliptical-shaped wide transfer groove which is provided along the linking oil passage 24. 26 is an oil passage for lock release which links the transfer groove 25 and the small gap 21*a* for oil passage. 27 is a slide plate which is stored to displace the transfer groove 25. The slide plate 27 divides the linking oil passage 24 into the oil passage 24*a* on the retarding side which passes through the retarding hydraulic pressure chamber 12 and the oil passage 24*b* on the advancing side which passes through the advancing hydraulic pressure chamber 13. The slide plate 27 has the function of a switching valve. Thus the slide plate 27 displaces to a position which connects the oil passage 26 for lock release to the oil passage 24*a* on the retarding side by displacing towards the advancing hydraulic pressure chamber 13 as a result of hydraulic pressure from the retarding hydraulic pressure chamber 12 when the hydraulic pressure in the retarding hydraulic pressure chamber 12 is higher than hydraulic pressure in the advancing hydraulic pressure chamber 13. The slide plate 27 displaces to a position which connects the oil passage 26 for lock release to the oil passage 24*b* on the advancing side by displacing towards the retarding hydraulic pressure chamber 12 as a result of hydraulic pressure from the advancing hydraulic pressure chamber 13 when the hydraulic pressure in the advancing hydraulic pressure chamber 13 is higher than hydraulic pressure in the retarding hydraulic pressure chamber 12.

A valve timing regulation device constructed as shown above in a first embodiment forms the first rotating and second rotating bodies 2, 6 from a material with a different linear expansion coefficient.

That is to say, in embodiment 1, on of the constituent material of the first rotating body 2 comprised of the timing rotating body 3, the case 4 and the covering material 14 with that of the second rotating body (rotor) 6 which is stored in the first rotating body 2, the second rotating body 6 is formed from a material with a higher linear expansion coefficient than that of the first rotating body 2. An engagement hole 21 stores a lock pin 20 in the second rotating body and the pin 20 can displace in a direction which is parallel with the rotational axis of the cam shaft 1. The engagement hole is provided in the first rotating body 2 which is formed from a material with a smaller linear expansion coefficient than that of the second rotating body 6.

The operation of the invention will be described below.

During operation of the internal combustion engine, a rotational force from the crankshaft (not shown) of the internal combustion engine is transmitted to the timing rotating body 3 of the first rotating body 2. At this time, the lock pin 20 is inserted into the engagement hole 21 by the mechanical biasing force of the spring 22 and the first and second rotating bodies 2, 6 are in a locked state (the state in FIG. 1). Thus a cam (not shown) which is integrally linked to the camshaft 1 opens and closes the intake and exhaust valves of the internal combustion engine as the camshaft 1 and the first and second rotating bodies 2, 6 rotate together. In such a state, a hydraulic pressure is supplied from the hydraulic pressure control system in response to the operational condition of the internal combustion engine to the engagement hole 21 and the retarding and advancing oil pressure chambers 12, 13. When the hydraulic force supplied to the engagement hole 21 overcomes the biasing force of the spring on the lock pin 20, the lock pin 20 retracts from the engagement hole 21 and the locking of the first and second rotating bodies 2, 6 is released. Due to lock release, the first and second rotating bodies 2, 6 can rotate relative to one another. Thus opening and closing timing of the intake and exhaust valves is automatically controlled by the rotation of the second rotating body 6 as a result of the pressure differential of the advancing and retarding hydraulic pressure chambers 12, 13.

In accordance to embodiment 1 as described above, since the second rotating body 6 is formed from a material with a higher linear expansion coefficient than that of the first rotating body 2 and an engagement hole 21 stores the lock pin 20 on the second rotation body 6 and the pin 20 can operate m a direction which is parallel with the rotational axis of the cam shaft 1. The hole 21 is provided in the first rotating body 2 which is formed from a material with a smaller linear expansion coefficient than that of the second rotating body 6. The engagement hole 2 his provided in the first rotating body 2 which is formed from a material with a smaller linear expansion coefficient than that of the second rotating body 6 storing the lock pin 20 and has a sufficient mechanical strength with respect to shearing forces which are generated in the direction of rotation of the first and second rotating bodies 2, 6 when the lock pin 20 is engaged. As a result, it is possible to prevent deformation and early wear of the engagement hole 21 due to insufficient strength and it is possible to prevent shaking during engagement of the lock pin 20 and the engagement hole 21. It is also possible to prevent a reduction in control performance of the opening and dosing timing of the valve as a result of such shaking. Furthermore as shown above, the clearance between the sliding faces of the first and second rotating bodies 2, 6 can be set at minimum dimensions under high temperature conditions after starting the internal combustion engine due to the fact that the linear expansion coefficient of the second rotating body 6 stored in the first rotating body 2 is greater than that of the first rotating body 2. As a result of these set dimensions, at high temperatures, the thermal expansion ratio of the second rotating body 6 stored in the first rotating body 2 is greater than that of the first rotating body 2. Thus due to the difference in the thermal expansion ratio of the second rotating body 6 and the first rotating body 2, it is possible to suppress leakage of oil from the clearance due to reductions in the viscosity of working oil to extremely low levels due to the minimum width of the clearance. Furthermore at low oil temperatures, the clearance is on the other hand increased, however it is possible to suppress leakage of oil from the clearance due to the increased viscosity of the oil.

Thus a highly reliable valve timing regulation device with stabilized performance is obtained which stabilizes oil leakage from the clearance due to temperature variation during operation of the internal combustion engine and which maintains an optimal clearance in response to the temperature variation by using the variation in viscosity of the oil due to variation in the temperature of the working oil.

Embodiment 2

In Embodiment 2, the first rotating body 2 is formed from an iron material and the second rotating body 6 is formed from an aluminum material. This allows the constituent material of the first and second rotating bodies 2, 6 according to the first embodiment to be more concretely characterized. Thus it is not necessary to use a special high-priced material as a material with a different linear expansion coefficient to respectively comprise the first and second rotating bodies 2, 6. Furthermore the same advantage as the first embodiment above is obtained since the second rotating body 6 is formed from aluminum which has a greater linear expansion coefficient than the first rotating body 2 which is formed from an iron substance.

Embodiment 3

In embodiment 3, the first rotating body 2 and the second rotating body 6 according to the first and second embodiments are formed by a process of sintering of the iron material by casting or molding of aluminum material. Thus forming of the first and second rotating bodies is facilitated, efficiency is improved and costs are reduced.

Embodiment 4

In embodiment 4, the axial longitudinal length of the second rotating body (rotor) 6 is set to be shorter at ambient temperatures in the range of 20–80 microns than the axial longitudinal length of the case 4 of the first rotating body 2 according to embodiment 1 to embodiment 3 above. Table 1 below shows set dimensions obtained by experimentation.

TABLE 1

| MATERIAL LINEAR EXPANSION COEFFICIENT | | FIRST ROTATION BODY IRON $1.2 \times 10^{-5}$ | SECOND ROTATION BODY ALUMINIUM $2.3 \times 10^{-5}$ | CLEARANCE (MICRONS) |
|---|---|---|---|---|
| TEMPER-ATURE | −25° C. | 22.986 mm | 22.9136 mm | 72.6 |
| | 25° C. | 23 mm | 22.94 mm | 40 |
| | 175° C. | 23.0414 mm | 23.0019 mm | 22.3 |

In Table 1, the first rotating body is taken to be only the case 4 according to the first embodiment and the case 4 is formed by an iron material. The second rotating body is formed from a rotor 6 formed by an aluminum material. The axial longitudinal lengths of the first and the second rotating bodies at 25 degrees C are respectively set at 23 mm and 22.94 mm. As a result of this setting, the clearance of the sliding faces of the first and the second rotating bodies is 40 microns.

When the temperature of the first and the second rotating body is varied under the same conditions, at −25 degrees C., the axial longitudinal length of the first rotating body formed from an iron material contracts to 22.986 mm and the axial longitudinal length of the second rotating body formed from an aluminum material contracts to 22.9136 mm. Due to the difference in thermal contraction, the clearance of the sliding faces of the first and the second rotating bodies expands to 72.6 microns. At a temperature of 175 degrees C., the axial longitudinal length of the first rotating body expands to 23.0414 mm and the axial longitudinal length of the second rotating body becomes 23.00191 mm. Thus the clearance of the sliding faces of the first and the second rotating bodies becomes 22.3 microns. Here the clearance due to the thermal expansion from a low to a high temperature (for example −40 degrees C. to 150 degrees C.) of the first and the second rotating bodies due to thermal expansion is 70 microns. When the clearance is below this value, the rotation of the second rotating body (rotor) is locked. Conversely, when a clearance during thermal expansion from −40 degrees C. to 150 degrees C. is set to more than or equal to 100 microns for example, the amount of oil leaking from that clearance increases to a level which impedes oil pressure control performance.

Thus when the second rotating body 6 shown in FIG. 1 is formed from an aluminum material and stores a lock pin 20 which can be operated in an axial direction, the clearance between the sliding faces of the second rotating body 6 and the first rotating body 2 which is formed from an iron material must be set in the range of 22.3–72.6 microns at ambient temperature (25 degrees C.). As a result of this setting, as shown above, the axial longitudinal length of the second rotating body 6 is shorter than the axial longitudinal length of the first rotating body 2 in the range of 20–80 microns at ambient temperature.

As shown above, according to embodiment 4, since the axial longitudinal length of the second rotating body 6 which is formed from an aluminum material and which stores a lock pin 20 which operates in an axial direction is shorter in the range of 20–80 microns at ambient temperature than the axial longitudinal length of the first rotating body 2 which is formed from an iron material, it is possible to reduce the clearance between the first and second rotating bodies 2, 6 to extremely low levels at high temperatures due to the difference in the thermal expansion of the two components. At low temperatures, the clearance between the two components is increased due to the difference in the thermal contraction of the first and the second rotating bodies. However since the viscosity of the working oil is increased, it is possible to suppress leakage of oil from the clearance, to maintain an optimal clearance in response to the temperature variation when operating the internal combustion engine and to improve control performance of the valve opening and dosing timing.

Embodiment 5

In embodiment 5, the lock pin 20 stored in the second rotating body 6 in embodiment 1 is formed from the same aluminum material as the second rotating body 6, that is to say, from a material with approximately the same linear expansion coefficient as the second rotating body 6.

In this way, the thermal contraction ratio and thermal expansion ratio of the lock pin 20 and the second rotating body 6 are equal due to the fact that the lock pin 20 and the second rotating body 6 are formed from a material with approximately the same linear expansion coefficient. Thus a gap in the radial direction between pin hole 19 of the second rotating body 6 and the lock pin 20 which slides in the pin hole 19 which may cause the second rotating body to perform "hunting" on engine start-up is not generated.

Embodiment 6

Figure 3:
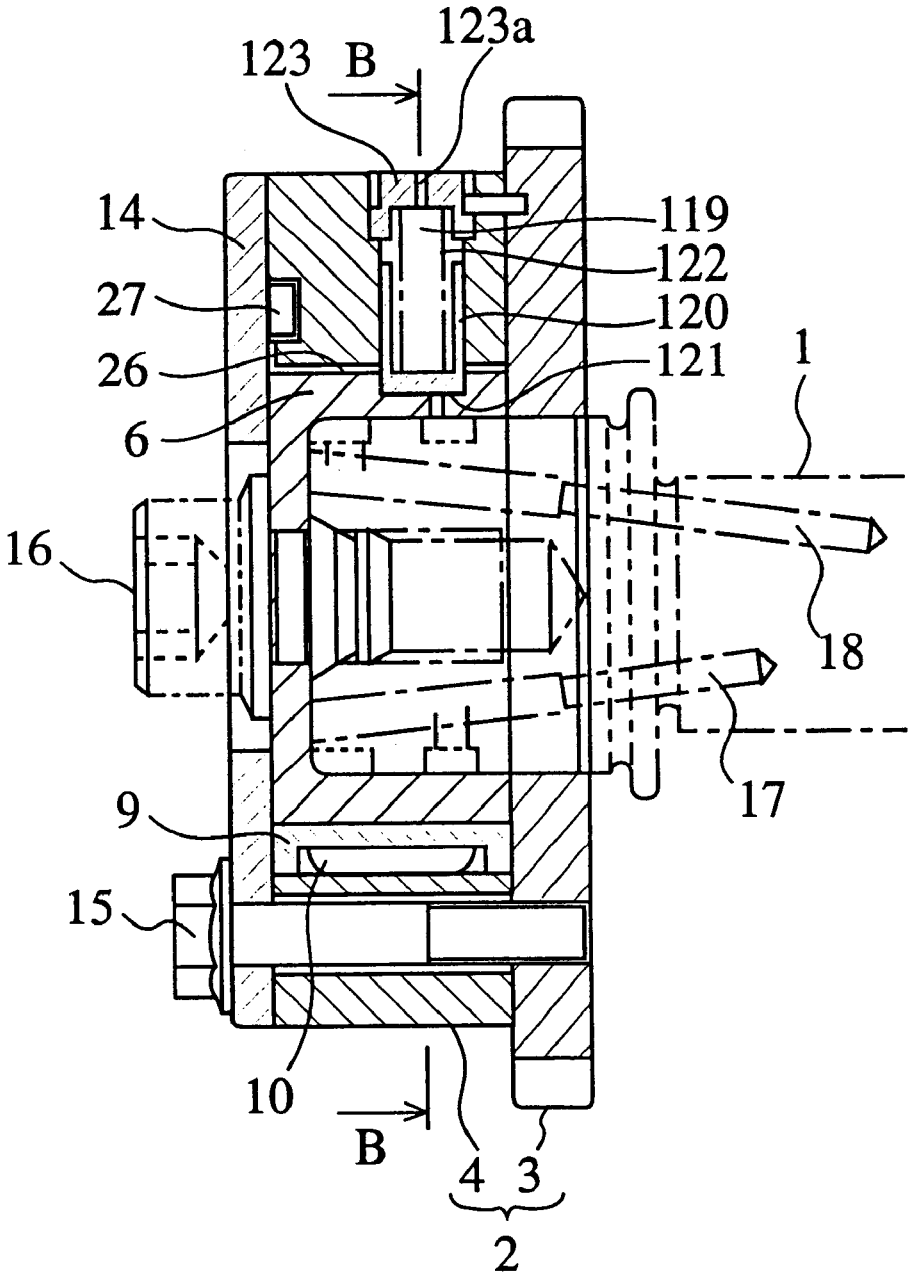
FIG. 3 is a cross sectional view of a valve timing regulation device according to a sixth embodiment of the present invention.
Figure 4:
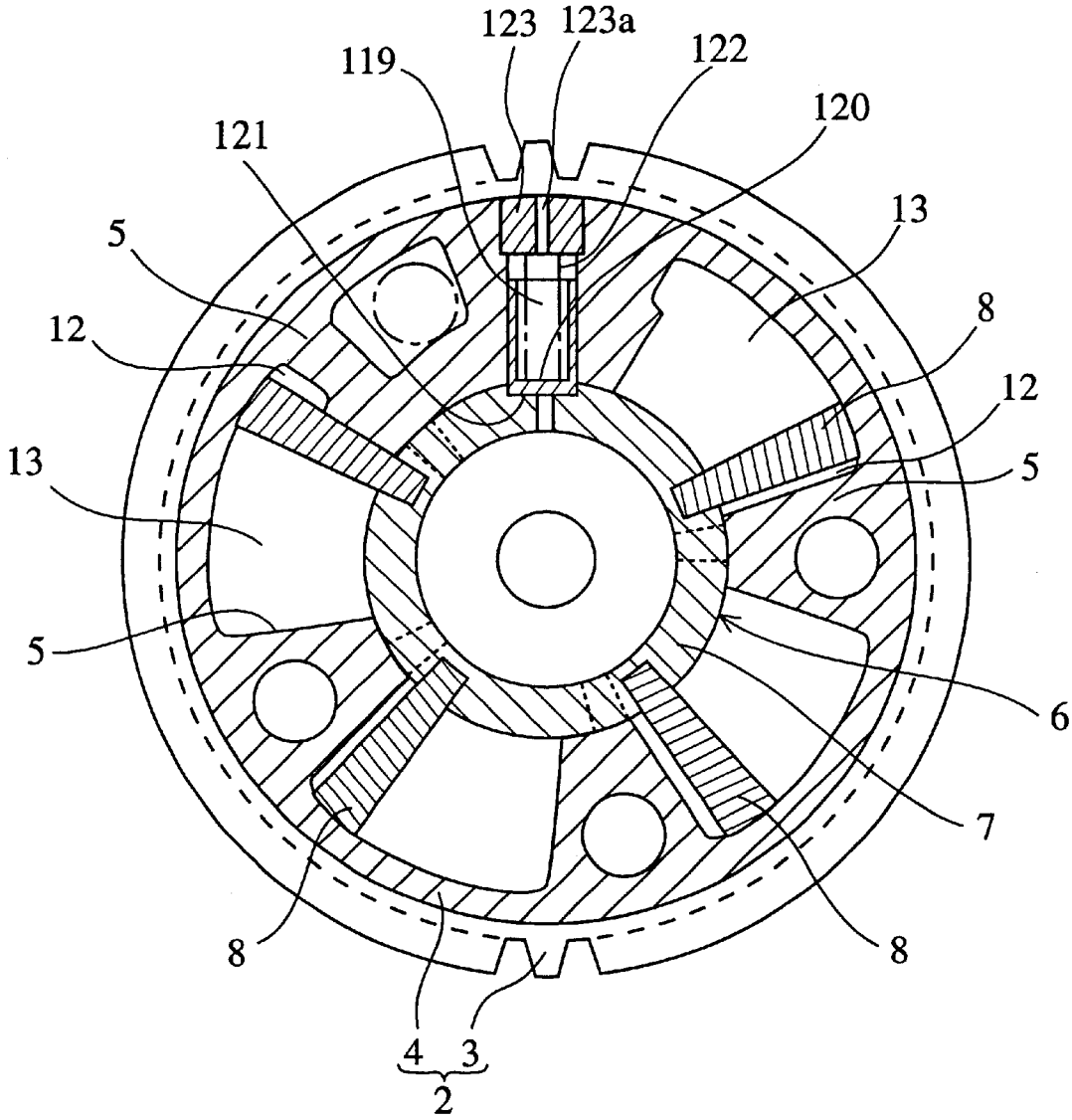
FIG. 4 is a perspective drawing on a cross section along the line B—B in FIG. 3.

FIG. 3 is a cross sectional view of a valve timing regulation device according to a sixth embodiment of the present invention. FIG. 4 is a perspective drawing on a cross section along the line B—B in FIG. 3. Those components which are the same or similar to those in FIG. 1 and FIG. 2 are represented by the same reference numerals and no further description will be given.

In the FIGS., 119 denotes a pinhole provided in one shoe 5 in the case 4. The pinhole 119 is formed by a through hole in a radial direction piercing the shoe 5 in the rotational center of the case 4. 120 is a lock pin (lock means) which is insertably stored in the pinhole 119 and which slides in the radial direction of the case 4. 121 is an engagement hole provided in the rotational body 7 of the rotor 6 on which the shoe 5 which has a lock pin 120 slides. The engagement hole 121 is formed from an indented hole which insertably fits the lock pin 120. 122 is a spring (mechanical biasing means) which biases the lock pin 120 in a direction of engagement with respect to the engagement hole 121. 123 is a valve which is attached to the outer side of the aperture of the pinhole 119. The valve 123 has an air release hole 123*a* and functions as a holder for the spring 122.

In the first embodiment, a linking oil passage 24, a transfer groove 25, a lock release oil passage 26 and a slide plate 27 are provided on a single vane 8 which has a lock pin 20. The linking oil passage 24, transfer groove 25 and lock release oil passage 26 act as lock release oil passage system for supporting the lock pin 20 against the biasing force of the spring 22 and operating the lock pin 20 in a direction of releasing of the engagement with the engagement hole 21 with a hydraulic control pressure. The slide plate 27 acts as an oil passage switching means which links the lock release oil passage 26 selectively to the retarding and advancing hydraulic pressure chambers 12, 13. The lock release oil passage system and oil passage switching means are provided on a single shoe in embodiment 6. Thus since the action is essentially the same as that described in embodiment 1 above, in the lock release oil passage system and oil passage switching means, those components which are the same or similar to those as described in embodiment 1 are denoted by the same numerals and will not be further described.

As above in embodiment 6, a valve timing regulation device which is provided with a lock pin 120 in a single shoe 5 of the case 4 and which operates the lock pin 120 in a radial direction of the case 4 forms a rotor (second rotating body 6) with a material which has a smaller linear expansion coefficient than the material constituting the first rotating body 2 containing the case 4.

The operation of the valve timing regulation device according to embodiment 6 is essentially the same as that of embodiment 1 except with respect to the fact that the direction of operation of the lock pin 120 is in a radial direction about the axial center of the rotor 6 and case 4.

According to embodiment 6 as described above, the second rotating body 6 is formed from a material which a smaller linear expansion coefficient than the first rotating body 2 providing a lock pin 120 which can operate in a radial direction of the case on one shoe 5. An engagement hole 121 is provided on the second rotating body 6. The engagement hole 121 which is provided on the second rotating body 6 has a smaller linear expansion coefficient than the first rotating body 2 and has sufficient mechanical strength. As a result, the engagement hole 121 prevents deformation or early wear during engagement with the lock pin 120. In addition, it is possible to prevent shaking between the two components during engagement of the lock pin 120 and the engagement hole 121. It is possible to prevent reductions in control performance of valve opening and closing by suppressing hunting when the internal combustion engine is started.

Embodiment 7

In embodiment 7, a first rotating body 2 provided with a lock pin 120 which is operable in a radial direction is formed from an aluminum material. A second rotating body 6 provided with an engagement hole 121 which engages the lock pin 120 is formed from an iron material. Thus the constituent material of the first and second rotating bodies in embodiment 6 above may be stated with greater precision. In this way, since the second rotating body 6 formed from an iron material has a smaller linear expansion coefficient than the first rotating body 2 formed from an aluminum material, the same advantage as embodiment 6 can be obtained and in addition, it is not necessary to use a special high-cost material as different materials to constitute the first and second rotating bodies respectively.

Embodiment 8

In embodiment 8, the first rotating body 2 according to embodiments 6 or 7 is formed by casting or molding of an aluminum material and the second rotating body 6 is formed from an iron material by sintering. Thus formation of the first and second rotating bodies 2, 6 is facilitated, efficiency is enhanced and costs are reduced.

Embodiment 9

In embodiment 9, the axial longitudinal length of the second rotating body (rotor) 6 with respect to embodiments 6 to 8 is set to be shorter than that of the first rotating body 2 in a range of 20–80 microns at ambient temperature. Table 2 below shows set dimensions obtained by experimentation.

TABLE 2

| MATERIAL LINEAR EXPANSION COEFFICIENT | | FIRST ROTATION BODY IRON $2.3 \times 10^{-5}$ | SECOND ROTATION BODY ALUMINIUM $1.2 \times 10^{-5}$ | CLEARANCE (MICRONS) |
|---|---|---|---|---|
| TEMPERATURE | −25° C. | 22.9736 mm | 22.9434 mm | 30 |
| | 25° C. | 23 mm | 22.96 mm | 40 |
| | 175° C. | 23.0794 mm | 23.00 mm | 80 |

In Table 2, the first rotating body is taken to be the case 4 according to the sixth embodiment and the case 4 is formed by an aluminum material. The second rotating body is comprised of a rotor 6 formed by an iron material in the same way as embodiment 6. The axial longitudinal lengths of the first and the second rotating bodies at an ambient temperature of 25 degrees C. are respectively set at 23 mm and 22.96 mm. As a result of this setting, the clearance of the sliding faces of the first and the second rotating bodies is 40 microns.

When temperature of the first and the second rotating body is varied under the same conditions, at −25 degrees C., the axial longitudinal length of the first rotating body formed from an aluminum material contracts to 22.9736 mm and the axial longitudinal length of the second rotating body formed from an iron material contracts to 22.9434 mm. Due to the difference in thermal contraction, the clearance of the sliding faces of the first and the second rotating bodies becomes 30 microns. At a temperature of 175 degrees C., the axial longitudinal length of the first rotating body expands to 23.0794 mm and the axial longitudinal length of the second rotating body expands to 23 mm. Thus the clearance of the sliding faces of the first and the second rotating bodies becomes 80 microns.

Thus when the first rotating body 2 shown in FIG. 3 is formed from an aluminum material and stores a lock pin 20 which can be operated in an axial direction on a shoe 5 of the case 4, the clearance between the sliding faces of the first rotating body 2 and the second rotating body 6 which is formed from an iron material and provides an engagement hole 121 in a radial direction which engages the lock pin 120 must be set in the range of 30–80 microns at an ambient temperature (25 degrees C.). As a result of this setting, as shown above, the axial longitudinal length of the second rotating body 6 is shorter than the axial longitudinal length of the first rotating body 2 in the range of 20–80 microns at ambient temperature.

As shown above according to embodiment 9, since the axial longitudinal length of the second rotating body 6 which is stored in the first rotating body 2 is shorter in the range of 20–80 microns at ambient temperature than the axial longitudinal length of the first rotating body 2 which has a shoe 5 which stores a lock pin 120 which is operable in a radial direction, it is possible to maintain a suitable clearance in response to temperature variation during operation of the internal combustion engine and to improve control performance of valve opening and closing timing.

Embodiment 10

In embodiment 10, the lock pin 120 which is stored in the first rotating body 2 in embodiments 6 to 8 is formed from a material with the same linear expansion coefficient as the first rotating body 2, that is to say, an aluminum material.

In such a way, the thermal expansion and contraction of the lock pin 120 and the first rotating body 2 is the same due to the formation of the lock pin 120 and the first rotating body 2 from an aluminum material with the same linear expansion coefficient. Thus the advantage is obtained that a gap in a radial direction between the pin hole 119 of the first rotating body 2 and the lock pin 120 which slides in the pin hole 119 is not generated. Such gaps cause the second rotating body 6 to perform hunting on starting the internal combustion engine.

It can be seen from the discussion above that the present invention forms a second rotating body which is stored to rotate in a fixed angular range relative to the interior of a first rotating body which is rotated by the output force of an internal combustion engine. The second rotating body is linked to a camshaft which opens and closes the intake and exhaust valves of an internal combustion engine. The second rotating body is formed from a material which has a greater linear expansion coefficient than a first rotating body. An engagement hole is provided in the first rotating body for storing a lock means which is operable in an axial direction of the second rotating body and which engages with the lock means. Thus engagement hole which is provided on the first rotating means which has a smaller linear expansion coefficient than the second rotating body which stores the lock means obtains sufficient mechanical strength with respect to the shear force generated during engagement with the lock means. As a result, it is possible to prevent deformation and early wear due to deficiencies in the strength of the engagement hole. Furthermore it is possible to prevent shaking during engagement of the lock means and the engagement hole as well as hunting as a result of shaking when the internal combustion engine is started. It is also possible to improve control performance of the opening and dosing timing of the valve.

Furthermore as shown above, since the linear expansion coefficient of the second rotating body stored in the first rotating body is greater than that of the first rotating body, it is possible to set dimensions which minimize the clearance between the sliding faces of the two components at high temperatures after starting the internal combustion engine. Due to the set dimensions, at high oil temperatures, the thermal expansion of the second rotating body is greater than that of the first rotating body and thus the clearance is minimized due to the difference in the thermal expansion ratio of the two components. Thus it is possible to suppress leakage of oil from the clearance due to reductions in oil viscosity to extremely low levels.

Again due to the set dimensions, at low oil temperatures, the clearance increases. However conversely, since the viscosity of the oil also increases, leakage of oil from the clearance can be suppressed.

Thus leakage of oil from the clearance due to temperature variation during operation of the internal combustion engine can be stabilized and it is possible to provide a valve timing regulation device which maintains a suitable clearance in response to temperature variation by the use of variations in viscosity due to temperature variation in the working oil and which displays high reliability with respect to stable performance.

According to the present invention, the first rotating body which has an engagement hole is formed from an iron material and a second rotating body which stores a lock means which can be engaged and disengaged in the engagement hole and which operates in a radial direction is formed from an aluminum material. Thus the linear expansion coefficient of the constituting material of the first and the second rotating bodies respectively differ. The advantage is obtained that a special high-cost material need not be used and that the formation of the first and the second rotating bodies is facilitated.

According to the present invention, it is possible to form the first rotating body by sintering of an iron material and to form the second rotating body by casting or molding of an aluminum material. Thus the formation of the first and the second rotating bodies is facilitated, efficiency is improved and costs are reduced.

According to the present invention, the axial longitudinal length of the second rotating body which has a greater linear expansion coefficient than the first rotating body is shorter than the axial longitudinal length of the first rotating body in the range of 20–80 microns at ambient temperature. Thus when a lock means is stored in the second rotating body which has a greater linear expansion coefficient, at high oil temperatures, it is possible to reduce the clearance between the sliding faces of the first and the second rotating bodies to an extreme level due to the difference in the thermal expansion of the two components. At low oil temperatures, although the clearance increases due to the difference in the thermal contraction of the first and second rotating bodies, the viscosity of the working oil is increased. Thus it is possible to suppress oil leakage from the clearance due to the high viscosity of the working oil. Thus an optimal clearance can be maintained in response to temperature variations during operation of the internal combustion engine and the control performance with respect to valve opening and closing timing can be improved to that degree.

According to the present invention, the lock means which is stored in the second rotating body is formed from a material having approximately the same linear expansion coefficient as the second rotating body. Thus the thermal expansion and thermal contraction ratios of the second rotating body and the lock means are approximately the same. Thus it is possible to suppress the generation of a gap between the engagement hole of the first rotating body and the lock means which is engaged in the engagement hole. Furthermore it is possible to prevent the generation of hunting on starting the internal combustion engine.

According to the present invention, a second rotating body is stored in a first rotating body which is operated to rotate by the output force of an internal combustion engine. The second rotating body can rotate in a fixed angular range. The second rotating body is linked to a camshaft which opens and closes the intake and exhaust valves of an internal combustion and is formed from a material which has a smaller linear expansion coefficient than the first rotating body. An engagement hole is provided on the first rotating body to engage the lock means and to store the lock means which can operate in a radial direction of the second rotating body. The engagement hole provided in the first rotating body 2 which is formed from a material with a smaller linear expansion coefficient than that of the second rotating body storing the lock means has a sufficient mechanical strength with respect to shearing forces which are generated when the lock means is engaged. As a result, it is possible to prevent deformation and early wear of the engagement hole due to insufficient strength and it is possible to prevent shaking and hunting on starting the internal combustion engine caused as a result of shaking during engagement of the lock means and the engagement hole. It is also possible to prevent a reduction in control performance of the opening and closing timing of the valve.

According to the present invention, the first rotating body which stores a lock means which operates in a radial direction is formed from an aluminum material. A second rotating body which has an engagement hole which can be engaged and disengaged with the engagement means is formed from an iron material. Thus the respective linear expansion coefficients of the constituting material of the first and the second rotating bodies differ and the advantage is obtained that a special high-cost material need not be used and that the formation of the first and the second rotating body is facilitated.

According to the present invention, since the formation of the first rotating body is performed by casting or molding or an aluminum material and the formation of the second rotating body is performed by sintering of an iron material, the formation of the first and the second rotating body is facilitated, efficiency is improved and costs are reduced.

According to the present invention, the axial longitudinal length of the second rotating body which has a greater linear expansion coefficient than the first rotating body is shorter than the axial longitudinal length of the first rotating body in the range of 20–80 microns at ambient temperature. Thus when a lock means is stored in the second rotating body which has a greater linear expansion coefficient, at high oil temperatures, it is possible to reduce the clearance between the sliding faces of the first and the second rotating bodies to an extreme level due to the difference in the thermal expansion of the two components. At low oil temperatures, although the clearance increases due to the difference in the thermal contraction of the first and second rotating bodies, the viscosity of the working oil is increased. Thus it is possible to suppress oil leakage from the clearance due to the high viscosity of the working oil. Therefore an optimal clearance can be maintained in response to temperature variations during operation of the internal combustion engine and control performance with respect to valve opening and closing timing can be improved to that degree.

According to the present invention, the lock means which is stored in the first rotating body is formed from a material having approximately the same linear expansion coefficient as the first rotating body. Thus the thermal expansion and thermal contraction ratios of the first rotating body and the lock means are approximately equal. Therefore it is possible to suppress the generation of a gap between the engagement hole of the second rotating body and the lock means which is engaged in the engagement hole. Furthermore it is possible to prevent the generation of hunting on starting the internal combustion engine.

What is claimed is:

1. A valve timing regulation device comprising a first rotating body which rotates freely on a camshaft, said camshaft opening and closing at least one of an intake valve and an exhaust valve of an internal combustion engine, said first rotating body being rotated by an output force of an internal combustion engine, a second rotating body rotatable relative to said first rotating body in a fixed angular range, said second rotating body being engaged to said camshaft, and a locking means which is operated by a mechanical biasing force, which locks said relative rotation of said first and second rotating bodies and which releases said locking means on being operated by a hydraulic control pressure, said first rotating body and said second rotating body being disposed as to form a clearance therebetween, wherein said valve timing regulation device is further characterized in that said second rotating body is formed from a material having a greater linear expansion coefficient than said first rotating body so that the clearance decreases with increasing temperature, thereby counteracting oil leakage through the clearance due to decreased viscosity of the oil at higher temperatures, said locking means is disposed on said second rotating body, and is operated in a direction which is parallel with an axis of rotation of said first rotating body and said second rotating body, and an engagement hole is provided on said first rotating body and engages and disengages with said locking means, wherein said second rotating body and said locking means are formed from a material with approximately the same linear expansion coefficient.

2. A valve timing regulation device according to claim 1 wherein said first rotating body is formed from an iron-containing material, and said second rotating body is formed from an aluminum material.

3. A valve timing regulation device according to claim 1 wherein said first rotating body is formed by iron sintering, and said second rotating body is formed by aluminum casting or molding.

4. A valve timing regulation device according to claim 1 wherein an axial longitudinal length of said second rotating body is formed to be shorter in a range of 20 to 80 microns under ambient temperature than an axial longitudinal length of said first rotating body.

* * * * *

UNITED STATES PATENT AND TRADEMARK OFFICE

CERTIFICATE OF CORRECTION

PATENT NO. : 6,276,322 B1
DATED : August 21, 2001
INVENTOR(S) : Mutsuo Sekiya and Katsuyuki Numoto It is certified that error appears in the above-identified patent and that said Letters Patent is hereby corrected as shown below:

Column 7,
Line 1, change “dosing” with -- closing --;

Column 8,
Line 61, change “dosing” with -- closing --; and

Column 12,
Line 5, change “dosing” with -- closing --.

Signed and Sealed this

Twenty-fifth Day of March, 2003

JAMES E. ROGAN
*Director of the United States Patent and Trademark Office*